United States Patent [19]

McClure et al.

[11] Patent Number: 4,790,385

[45] Date of Patent: Dec. 13, 1988

[54] METHOD AND APPARATUS FOR PERFORATING SUBSURFACE EARTH FORMATIONS

[75] Inventors: Gerald B. McClure, Sugarland; William A. McPhee, Houston, both of Tex.

[73] Assignee: Dresser Industries, Inc., Dallas, Tex.

[21] Appl. No.: 670,835

[22] Filed: Nov. 13, 1984

Related U.S. Application Data

[63] Continuation-in-part of Ser. No. 516,811, Jul. 25, 1983, Pat. No. 4,491,185.

[51] Int. Cl.[4] ..... E21B 43/116

[52] U.S. Cl. ..... 166/299; 166/63; 175/4.56

[58] Field of Search ..... 166/299, 297, 63, 55, 166/55.1; 175/4.54–4.56, 4.6; 102/204, 305, 306, 310, 202.14, 202.5; 89/1.15

[56] References Cited

U.S. PATENT DOCUMENTS

| | | | |
|---|---|---|---|
| 3,001,584 | 9/1961 | Scott | 166/299 X |
| 3,422,760 | 1/1969 | Mohaupt | 166/63 X |
| 3,871,448 | 3/1975 | Vann | 166/128 |
| 3,931,855 | 1/1976 | Vann | 166/128 |
| 3,978,921 | 9/1976 | Ross | 166/63 X |
| 4,040,482 | 8/1977 | Vann | 166/255 |
| 4,151,880 | 5/1979 | Vann | 166/314 |
| 4,299,287 | 11/1981 | Vann | 166/297 |
| 4,330,039 | 5/1982 | Vann | 166/297 |

*Primary Examiner*—Stephen J. Novosad
*Assistant Examiner*—Thuy M. Bui

[57] ABSTRACT

A perforating system for completing subsurface formations transversed by a borehole. A sub with a plurality of closed vent ports and a perforating gun are run into a borehole on the end of a tubing string. To initiate the perforating system an impact member is dropped through the tubing string. The impact member strikes a percussion firing head which initiates a detonation wave in a detonator cord. The detonation wave detonates an explosive pellet within the sub, the resulting explosion initiating a pressure wave which forcibly opens the vent ports and fluidly communicates the well bore to the tubing annulus. The detonation wave continues on in the detonator cord to actuate the perforating gun.

19 Claims, 5 Drawing Sheets

METHOD AND APPARATUS FOR PERFORATING SUBSURFACE EARTH FORMATIONS

RELATED APPLICATIONS

This is a continuation-in-part of patent application Ser. No. 516,811, filed July 25, 1983, now Pat. No. 4,491,185 entitled "Method and Apparatus for Perforating Subsurface Earth Formations."

BACKGROUND OF THE INVENTION

This invention relates generally to subsurface well apparatus and more specifically, to methods and apparatus for perforating subsurface earth formations utilizing a tubing conveyted perforating apparatus.

It has become common practice in completion of oil and gas wells to perforate the well casings and the surrounding formations to bring a well into production. One method of providing this capability has a perforating apparatus attached to the end of a tubing string which is lowered and set in place when the perforating apparatus is opposite the formation to be produced. The perforating apparatus may then be detonated and the well placed into production throught the tubing strings. It has also become common practice in the completion of oil and gas wells using the tubing conveyed perforating methods to intentionally create a pressure differential between the formation and the well bore to remove well bore fluids and debris immediately prior to and during the perforating procedure. This removal of fluids and debris is done to prevent clogging of the perforations, thereby increasing the efficiency of production. One method of providing this capability is to use a venting system which allows the fluids and debris to enter the tubing annulus to be removed at the surface.

The venting systems have typically been either an open perforated nipple or a mechanically actuated device Neither system is entirely satisfactory because open perforated nipples cannot be used when the well bore fluids are under pressure, and the mechanically actuated devices utilize moving parts which may become damaged when placed in the well bore or may stick and never open.

These and other disadvantages are overcome with the present invention by providing an explosively actuated venting system which can be used in high pressure well bores and has no moving parts to fail or stick.

SUMMARY OF THE INVENTION

In a preferred embodiment of the invention, a perforating system is provided which, in its overall concept, includes a perforating gun and a sub with a plurality of closed vent ports. The sub is attached to the end of a tubing string and placed below the packer assembly. The perforating gun is attached to the end of the sub and placed adjacent a formation to be perforated. The perforating system is actuated by dropping an impact bar through the tubing string. The impact bar strikes a percussion firing head which initiates a detonation wave in a detonator cord. The detonation wave detonates an explosive pellet within the sub which produces a pressure wave in the surrounding fluid. The force of the pressure wave ruptures the rupture discs of the closed vent ports thereby opening the vent ports and fluidly communicating the well bore to the tubing annulus. The detonation wave continues on in the detonator cord past the explosive pellet to actuate the shaped charges of the perforating gun to perforate the adjacent formations.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
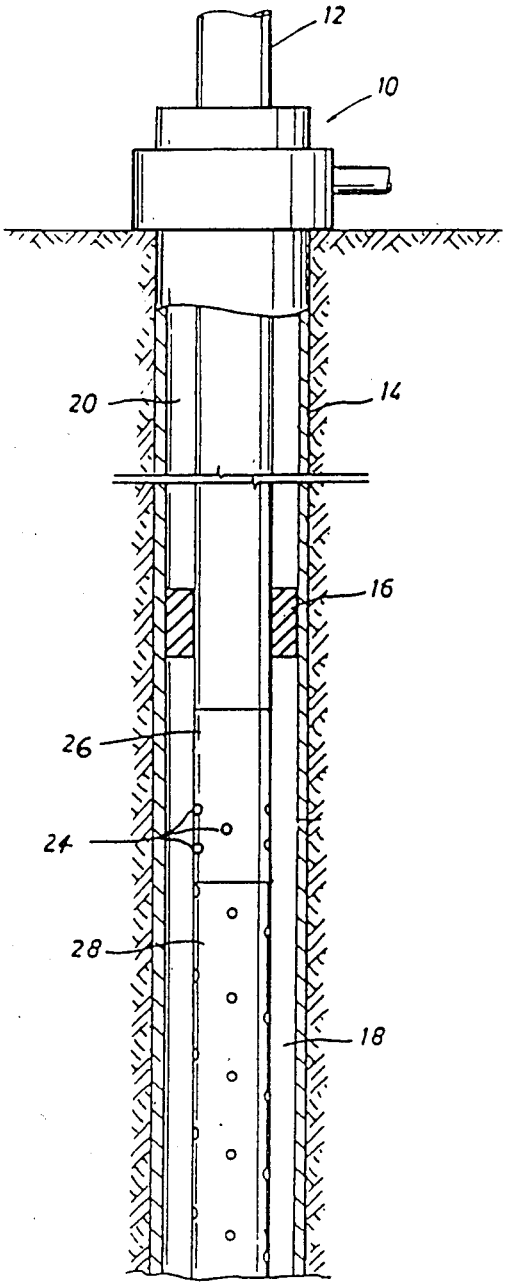
FIG. 1 is a schematic elevational view of a perforating operation within a cased wellbore in accordance with the present invention.
Figure 2A:
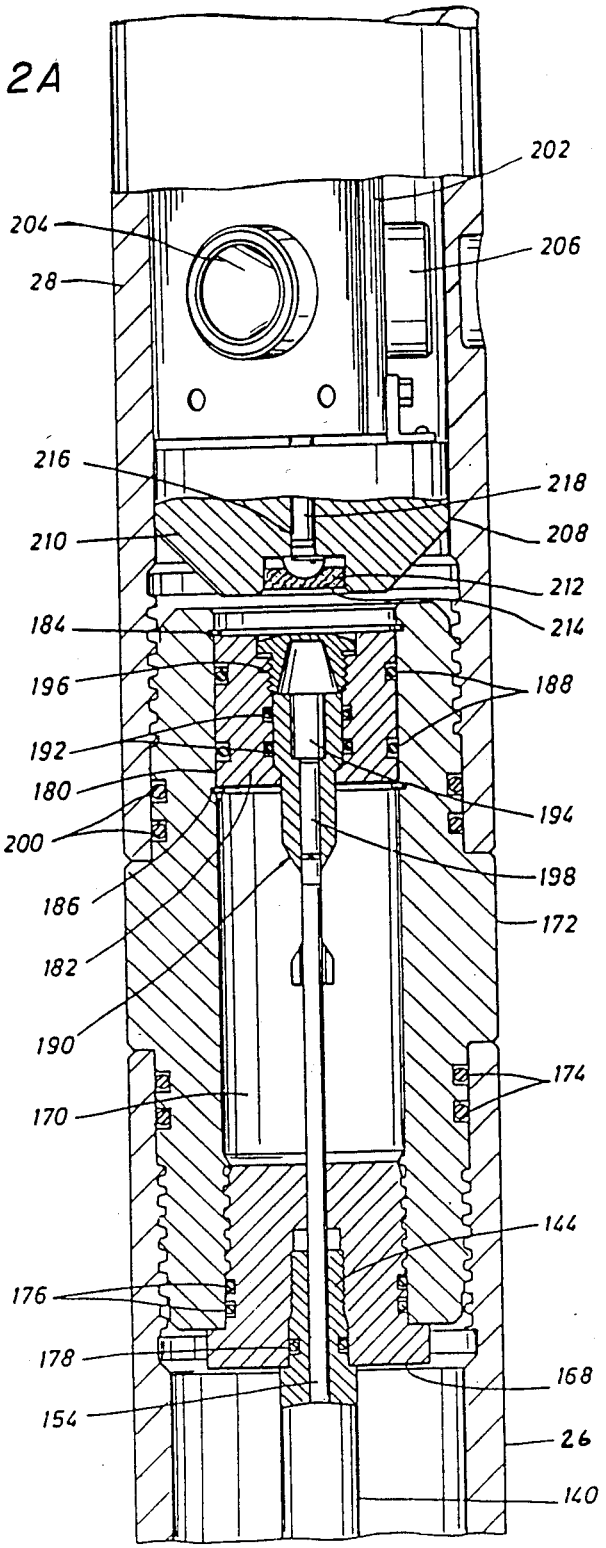
FIGS. 2A–2D are a longitudinal sectional view of the sub and a portion of the perforating gun of FIG. 1.
Figure 2B:
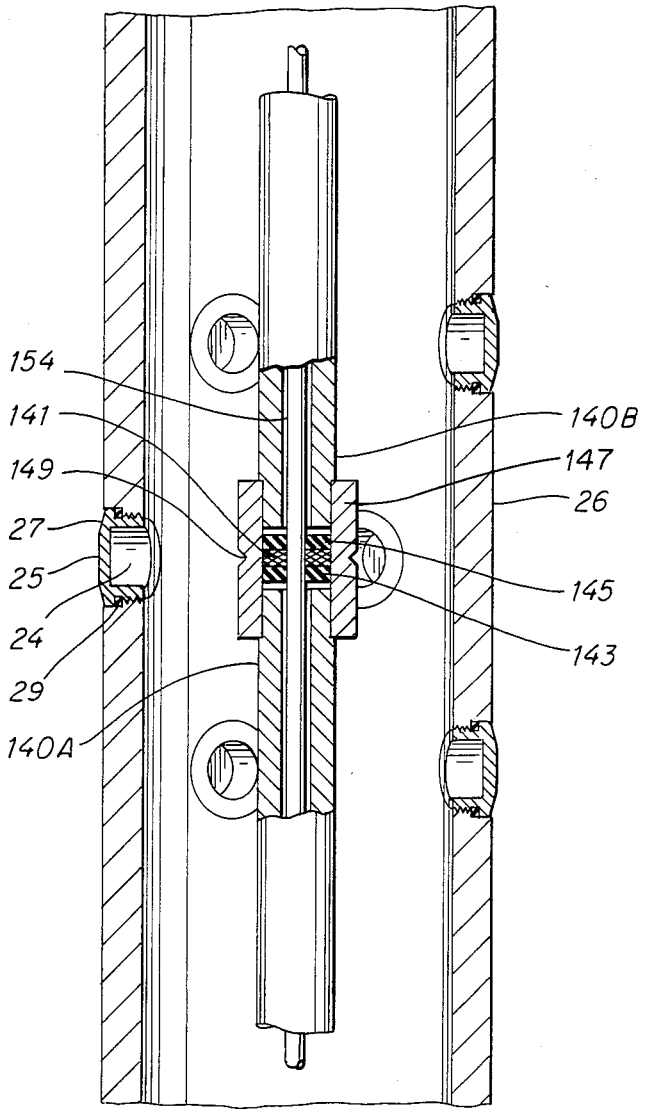
Figure 2C:
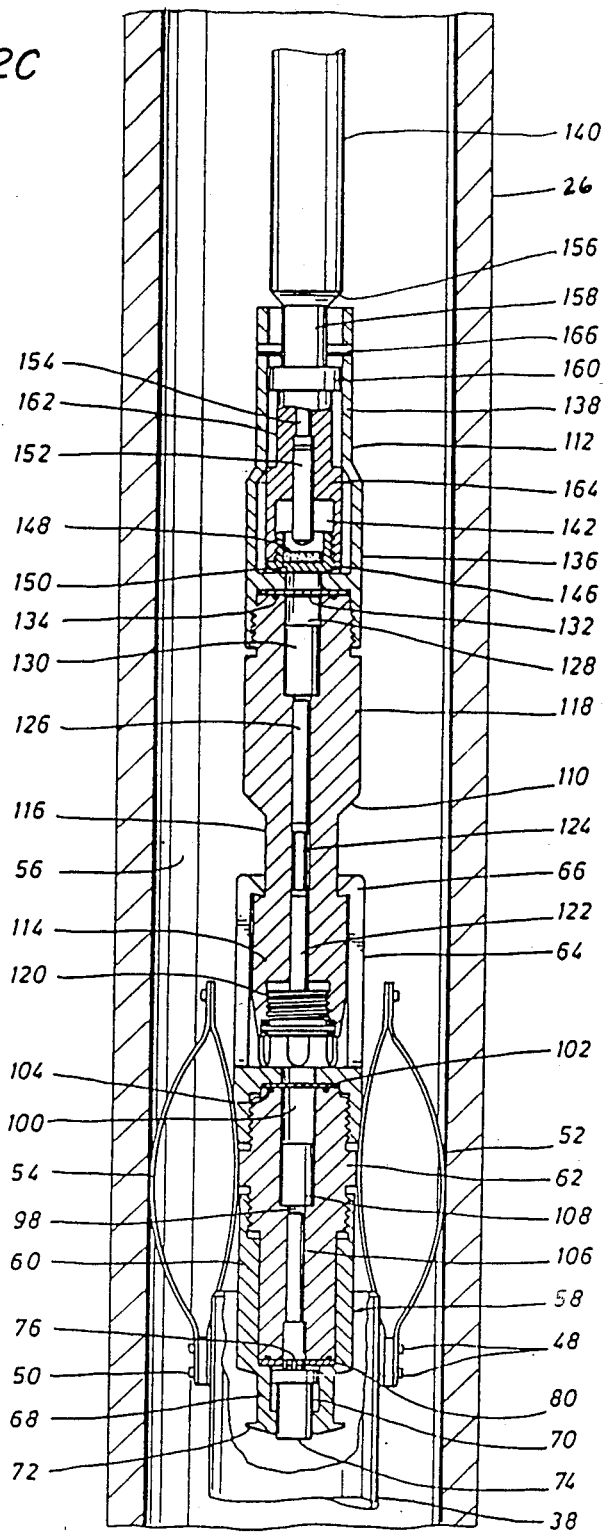
Figure 2D:
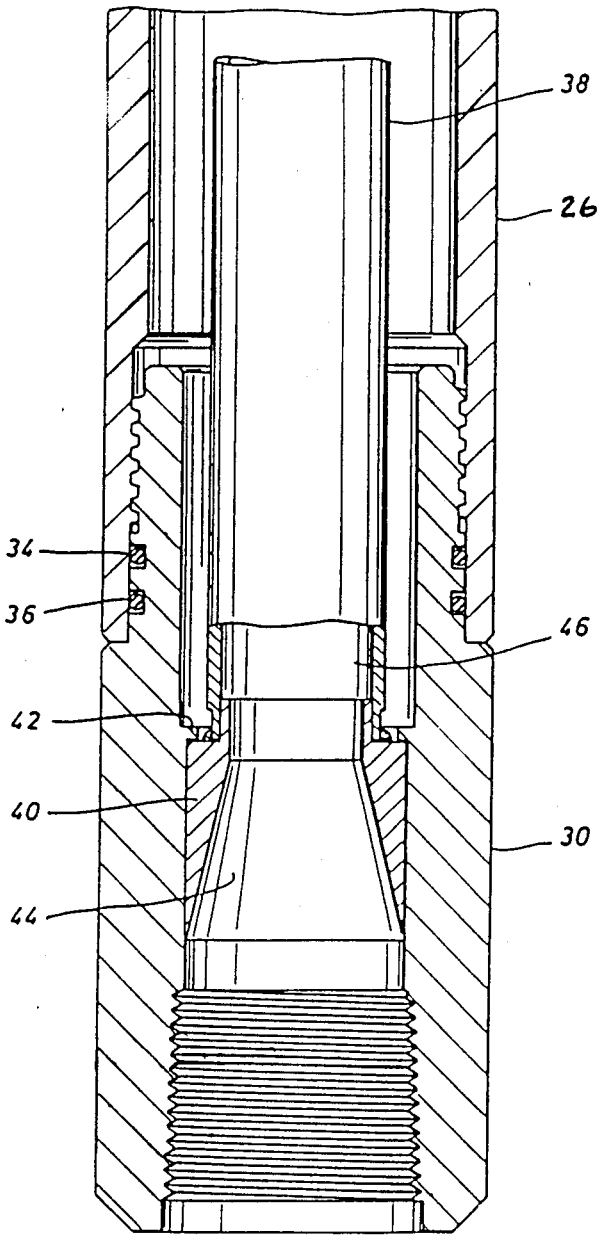

Referring now to the drawings in more detail, particularly to FIGS. 1 and 2B, there is illustrated a tubing conveyed perforating system in accordance with the present invention. A wellhead 10 has a tubing string 12 extending through the interior of a casing string 14. A suitable packer assembly 16, which can be of any number of commonly used forms, is attached to tubing string 12 and sealingly engages casing 14 dividing the casing annulus into a lower and upper annulus 18 and 20, respectively. A sub 26 is attached to tubing string 12 below packer assembly 16 and includes a plurality of vent ports 24 which when opened fluidly communicate lower annulus 18 with the interior of tubing string 12. Vent ports 24 are preferably, but not limited to, the hollow threaded screw type sealed by a rupture disc 25. Underlying the flanged ends 27 of rupture disc 25 is a seal member 29. In the preferred embodiment, vent ports 24 are set into sub 26 in a geometric pattern to preclude flow restriction, and of such number and size so as to make the combined open cross-sectional area greater than or equal to the cross-sectional area of tubing string 12. Mechanically coupled to sub 26 and disposed adjacent a potential hydrocarbon containing formation is perforating gun 28. Perforating gun 28 can be of any suitable type of the style commonly referred to as a "shaped charge" perforating gun.

Referring now to FIG. 2 there is illustrated partly in longitudinal section sub 26 attached to the upper end of perforating gun 28. Connector sub 30 is a generally cylindrical member having a screw threaded proximal end for attachment to tubing string 12. The second end section of connector sub 30 forms a reduced diameter externally threaded section. Sub 26 has a screw threaded socket concentric therewith for receiving the reduced diameter threaded end of connector sub 30. Seal members 34 and 36 provide a fluid occlusive seal isolating wellbore fluids from the interior of sub 26.

Mounted within connector sub 30 and extending into sub 26 is guide housing 38. Guide housing 38 is a generally cylindrical member having an enlarged outer diameter upper segment 40 engaging flange 42. The internal bore 44 of upper segment 40 is flared with the reduced diameter of the flare projecting into the internal passage 46 of the lower section of guide housing 38. Attached to guide housing 38, by suitable means such as screws 48 and 50, are centralizers 52 and 54, respectively. Centralizers 52 and 54 serve to keep guide housing 38 located substantially within the center of the internal bore 56 of sub 26.

Centralizers 52 and 54 additionally provide for the centering of the percussion firing assembly 58 within the internal passage 46 of guide housing 38 when such firing assembly 58 is installed within sub 26 in a manner to be more fully described later herein. Percussion firing assembly 58 includes firing pin housing 60 threadably coupled to firing sub 62 which is further coupled to grapple sub 64 terminating with dogs 66 having beveled ends. Firing pin housing 60 has a generally cylindrical section with a reduced diameter upper section 68 having a generally cylindrical cavity 70 formed therein. Upper section 68 has outwardly projecting flange 72 which allows percussion firing assembly 58 to be detachably coupled to a delivery tool, such as a setting tool affixed to a gamma ray instrument. This allows percussion firing assembly 58 to be lowered from the surface and latched into sub 26 after sub 26 and perforating gun 28 are located within the well.

Figure 3:
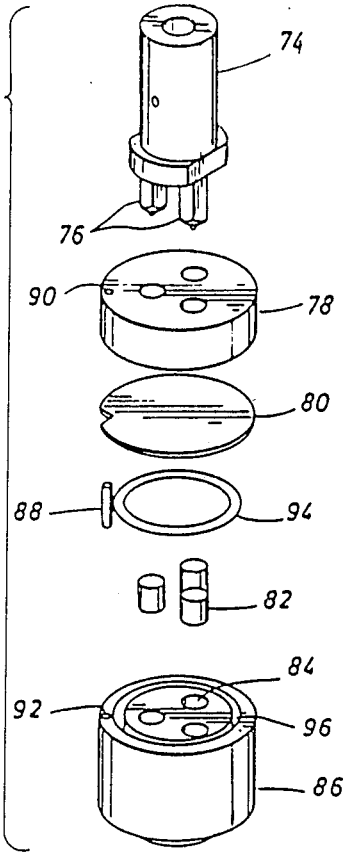
FIG. 3 is a more detailed view of the percussion firing assembly of the firing head assembly of FIG. 1.

A better understanding of the firing system can be had by reference to FIGS. 2 and 3 where there is illustrated in detail the percussion firing system of percussion firing assembly 58. Identical reference numbers are used for identical elements in these figures. Firing pin 74 is retained within cavity 70 with one end extending outside firing pin housing 60. A plurality of percussion ignition pins 76 are attached to the other end of firing pin 74. In the preferred embodiment three elongated ignition pins having hemispherically tapered ends are utilized. Ignition pins 76 extend through passages within retainer ring 78. Frangible barrier 80 isolates ignition pins 76 from explosive primer cartridges 82 which are retained within three cavities 84 within cartridge retainer 86. Alignment of ignition pins 76 with primer cartridges 82 is provided by alignment pin 88 which inserts into bore 90 of retainer ring 78 and bore 92 of cartridge retainer 86. Additionally, seal member 94 fits within circular groove 96 in cartridge retainer 86.

Returning now to FIG. 2, sub 62 has a first elongated bore 98 located along the longitudinal axis with a centrally located cavity 100 approximately one-half inch in diameter located at the lower end thereof. The opening of cavity 100 is covered by frangible barrier 102 which along with seal member 104, are held in place by the inward flange portion of grapple sub 64 when grapple sub 64 threadably engages sub 62. In the preferred embodiment frangible barriers 80 and 102 are constructed of steel approximately 0.060 inches in thickness. Located within bore 98 is explosive booster charge 106 which may be, for example a DuPont P-43 booster. The booster charges are relatively insensitive and not readily detonated other than by a force of an explosive nature as provided by primer cartridges 82. Shaped charge 108 is installed within cavity 100 in juxtaposition with booster 106 and has an axis of perforation aligned substantially along the longitudinal axis of sub 26.

Attached to grapple sub 64 is a primary stem explosive assembly inducing primary stem housing 110 threadably connected to adapter sleeve 112. Primary stem housing 110 has a tapered upper segment 114 below which is located a reduced outer diameter section 116 which flares into a generally circular segment 118. Mounted within a central cavity in upper segment 114 is an explosively loaded screw port 120, such as that found in U.S. patent application No. 476,448, now abandoned which is incorporated herein by reference. In juxtaposition with loaded screw port 120 is explosive booster charge 122 located in a central passage of primary stem housing 110. Booster 122 is preferably a Model P-3 supplied by DuPont Corporation. Crimp-connected to booster 122 is detonator cord 124 which is further crimp-connected to explosive booster charge 126 which is preferable a DuPont Model P-43. Mounted within cavity 128 in juxtaposition with booster 126 is shaped charge 130. Cavity 128 is sealed by frangible barrier 132 and sealing member 134 which are held in place by the inward flange portion of adapter sleeve 112.

Adapter sleeve 112 includes a generally cylindrical first section 136 tapering approximate the midpoint to a reduced diameter generally second cylindrical section 138. Projecting within adapter sleeve 112 is the upper end portion of secondary stem explosive assembly. Secondary stem explosive assembly includes a member 140 having a first end with cavity 142 formed therein and a second threaded end 144. Installed within cavity 142 is a loaded screw port 146. Loaded screw port 146, as with screw port 120, includes a quantity of explosive material 148 retained within a threaded member 150 commonly referred to as a screw port. Extending into cavity 142 is explosive booster charge 152, which in the preferred embodiment is a DuPont Model P-3, which is crimp connected to a detonator cord 154 which traverses the longitudinal bore of member 140. Detonator cord 154 is preferably, but not limited to, the type known commercially as R.D.X. plastic covered Primacord, a trademark of Ensign-Bickford Corporation. The first end of member 140 includes a tapered outer section 156, a reduced outer diameter section 158 followed by an enlarged outer diameter section 162 returning to an end portion 164 having an outer diameter equal to that of the main section of member 140. The lower end of cylindrical section 138 of adapter sleeve 112 is secured to section 158 of tubular member 140 by a pair of shear pins 166.

Intermediate within member 140 and surrounding detonator cord 154, is explosive pellet 141 which is preferably, but not limited to, the type commercially known as cyclonite. Between explosive pellet 141 and the first and second tubular members 140A and 140B, respectively, of member 140 are spacers 143 and 145. A stem coupling 147 surrounds and secures explosive pellet 141, spacers 143 and 145, and the immediately adjacent portions of first and second members 140A and 140B, respectively, of member 140. In the preferred embodiment, stem coupling 147 is a metal sleeve with a groove 149 on the exterior concentric to explosive pellet 141. Groove 149 provides a controlled fracture point upon detonation of explosive pellet 141 thereby lessening the risk of damage to sub 26.

Threadably attached to second end 144 of member 140 is bushing member 168 having a central bore therethrough traversed by detonator cord 154. Bushing member 168 is mounted within a central bore 170 of coupling sub 172 which is threadable coupled to sub 26. Occlusive seals are provided by seal members 174 between coupling sub 172 and firing head assembly housing 32, by seal members 176 between coupling sub 172 and busing member 168 and by seal member 178 between coupling sub 172 and member 140.

Mounted within coupling sub 172 is donor assembly 180 of the perforating gun detonating system. Donor assembly 180 includes an outer housing or bushing 182 sized for insertion within bore 170 of coupling sub 172 and has a central bore therethrough. A pair of retainer rings 184 and 186 constrain outer housing 182 within coupling sub 172 and a pair of seal members 188 provides an occlusive fluid seal therebetween. Retained within the central bore of bushing 182 and extending rearwardly therefrom is internal member 190 having a pair of seal members 192 thereabout. Mounted within an internal bore of internal member 190 is shaped charge 194. Shaped charge 194 may be of various designs known in the art, in the preferred embodiment is approximately one inch in length and one-half inch in outer diameter and having the type of explosive commonly referred to as cyclonite. Shaped charges 194, 130 and 108 are of common design. Screw port 196 is threadably installed within bushing 182 substantially in line with the axis of perforation of the "jet" produced by shaped charge 194. Retained within the rearward portion of internal member 190 and placed in juxtaposition with shaped charge 194 is booster charge 198 which is connected to detonator cord 154 and is preferably a Model P-3 booster available from DuPont Corporation.

Coupling sub 172 is threadably coupled to perforating gun 28. The threaded joint is provided with a fluid-tight seal by seal members 200. Perforating gun 28 includes a carrier member 202 retained therein. Mounted along the length of carrier member 202 are a plurality of shaped charges,, illustrated at 204 and 206 having their axis of perforation directed generally in the surrounding formations. Mounted within the central bore of perforating gun 28 is acceptor assembly 208 of the detonation system. Acceptor assembly 208 includes a housing or holder member 210 having a cavity formed generally centrally therein. Mounted within the cavity is a generally cup shaped pellet 212 explosive material. Explosive pellet 212 can be from approximately 2–6 grams of cyclonite or other suitable explosive material. The cavity is covered with a frangible barrier 214, such as a relatively thin piece of aluminum. Explosive booster charge 216 is connected by suitable means, such as a crimped-connection, to detonator cord 218. detonator cord 218 extends the length of the perforating gun 28 and provides the detonation of any shaped charges mounted therein. The second end of detonator cord 218 may be terminated at a donor assembly identical with the one described herein thereby allowing for the serial explosive coupling of additional perforating gun assemblies.

In the operation of the perforating system described in the Figures, perforating gun 28 and sub 26 are attached to tubing string 12 and positioned within the casing string 14 at a location below packer assembly 16. In accordance with the present invention no primary explosives are present in the perforating gun/firing head assembly during this operation. Firing sub 58 is lowered through tubing string 12 by means of a setting tool attached to a wireline (not shown). The setting tool couples over flange 72 of sub 60. By means of the wireline, the setting tool and firing sub are lowered through internal bore 44 of guide housing 38 until dogs 66 of grapple sub 64 engage the shoulder formed by the upper terminus of reduced diameter section 116 of primary stem housings 110. Once sub 60 is latched in place the setting tool and the wire line are removed from tubing string 12. To instigate ignition of perforating gun 28 an impact bar, commonly referred to as a "go devil" is dropped from the surface through tubing string 12. The impact bar passes through internal bores 44 and 46 of guide housing 38 hitting firing pin 74 driving ignition pins 76 through frangible barrier 80 onto primer cartridges 82. The explosion of primer cartridges 82 detonates booster charge 106 further detonating shaped charge 108.

Upon ignition, shaped charge 108 forms a "jet" which penetrates frangible barrier 102 and screw port 120 detonating the explosives material within screw port 120 thereby detonating booster charge 122. The detonation of booster charge 122 is coupled through detonator cord 124 to detonate booster charge 126 which in turn detonates shaped charge 130. The detonation of shaped charge 130 causes a jet to form penetrating frangible barrier 132 and screw port 150 igniting explosive booster charge 152. The detonation of booster charge 152 causes detonation wave to travel though detonator cord 154 to explosive pellet 141. Explosive pellet 141 detonates thereby producing a pressure wave in the surrounding fluid which in turn forcibly opens rupture disks 25 of vent ports 24 to fluidly communicate lower annulus 20 with the interior of tubing string 12. Stem coupling 147 separates at groove 149 upon detonation of explosive pellet 141 thereby providing control of said detonation which in turn minimizes damage to the surrounding apparatus. The detonation wave in detonator cord 154 continues past explosive pellet 141 to booster charge 154 to booster charge 198. Booster charge 198 transfers the detonation wave into shaped charge 194 causing a jet to be formed. The jet in turn detonates explosive pellet 212 thereby causing ignition of explosive booster charge 216. The detonation of booster charge 216 is transferred onto detonator cord 218 further detonating shaped charges 204, 206 and the other shaped charges in perforation gun 28, or subsequent perforating guns attached thereto.

In the event ignition of the perforating gun shaped charges is not caused by the impact bar, the present system provides a back-up electrical ignition method. An overshot grapple is lowered into the tubing string by means of a slick line or wireline. The grapple is lowered into guide housing 38 until the grapple engages flange 72 of percussion firing assembly 58. Upward tension is exerted causing shear pins 166 to break allowing percussion firing assembly 58 and primary stem housing 110 to be removed from sub 26. With percussion firing assembly 58 and primary stem housing 110 removed an electrical firing head can be attached to a wireline and lowered through tubing string 12 into sub 26. The electrical firing head is equipped with a grapple sub-identical to grapple sub 64. The electrical firing head is lowered into firing head assembly 32 until the dogs, which are identical to the dogs 66 of grapple sub 64, clamp over end portion 164 onto the shoulder of elongated tubular member 140 of the secondary stem explosive assembly. An electrical signal can then be transmitted from the surface to a detonator located in the electrical firing head, thereby igniting a shaped charge which forms a jet further igniting explosive material 148 and booster charge 152 which detonates the system in the manner hereinbefore described. Should the electrical firing head fail to detonate the perforating gun the electrical firing head is pulled off by tension from the wireline and is removed from the well. Perforating gun 28 and sub 26 can then be removed by pulling tubing string 12. Since no primary explosives are present the danger of accidental ignition during the removal process are all but eliminated.

Many modifications and variations besides those specifically mentioned may be made in the techniques and structures described herein and depicted in the accompanying drawing without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. A method of establishing fluid communications between a well bore annulus and a tubing annulus, comprising the steps of:

positioning on the end of a tubing string below a packer assembly within said well bore annulus a sub having a plurality of vent ports closed by rupture discs, said tubing string having a tubing annulus fluidly isolated from said well bore annulus; and initiating a shock pressure wave originating within said sub, said pressure wave forcibly opening said vent ports by rupturing said rupture discs, thereby fluidly communicating said well bore annulus to said tubing annulus.

2. The method as recited in claim 1, wherein said pressure wave is initiated by the detonation of an explosive means within said sub.

3. Apparatus for fluidly communicating a well bore to a tubing annulus, including a sub having a plurality of closed vent ports, said sub further comprising:

explosive means for initiating a pressure wave originating within said sub for forcibly opening said closed vent ports for fluidly communicating said well bore to said tubing annulus;

means for detonating said explosive means; and housing means for housing said explosive means and said detonating means.

4. The apparatus of claim 3, wherein said explosive means further comprises a quantity of explosive material.

5. The apparatus of claim 3, wherein said detonating means further comprises a quantity of detonator cord.

6. The apparatus of claim 3, wherein said housing means further comprises a member within said sub for housing said explosive means and said detonating means.

7. The apparatus of claim 6 wherein said member further comprises:

first and second tubular members;

explosive means intermediate between said first and second tubular members;

spacer positioned between both said explosive means and said first tubular member, and said explosive means and said second tubular member;

detonating means transversing said member for detonating said explosive means; and coupling means for coupling said first and second tubular members, spacers and explosive means.

8. The apparatus of claim 7 wherein said coupling means further comprises a sleeve overlapping said spacers, explosive means and adjacent portions of said first and second members, for coupling said first and second members, spacers and explosive means, and said sleeve including a groove in the exterior of said sleeve concentric to said explosive means for providing a fracture point in said sleeve.

9. The apparatus of claim 3 wherein said closed vent ports further comprise means for precluding fluid flow between said well bore and said tubing annulus set into apertures in said sub.

10. The apparatus of claim 9 wherein said means for precluding fluid flow between said well bore and said tubing annulus further comprises a rupture disc.

11. A perforating apparatus for perforating subsurface earth formations surrounding a borehole and establishing fluid communications between said borehole and a tubing string annulus including a perforating gun adapted to be conveyed into a borehole at the end of a length of tubing string and having a sub with a plurality of closed vent ports for isolating the borehole from the tubing string annulus interposed therebetween, said sub further comprising:

explosive means for initiating a shock pressure wave originating within said sub for forcibly opening said closed vent ports;

detonating means for detonating explosive means;

housing means for housing said explosive means and said detonating means; and firing means attached to said housing means for activating said detonating means.

12. The apparatus of claim 11, wherein said explosive means further comprises a quantity of explosive material.

13. The apparatus of claim 12, wherein said detonating means further comprises a quantity of detonator cord.

14. The apparatus of claim 13, wherein said housing means further comprises:

a tubular member within said sub for housing said explosive means and said detonating means.

15. The apparatus of claim 14 wherein said member further comprises:

first and second members;

explosive means intermediate between said first and second tubular members;

a spacer positioned between both said explosive means and said first tubular member, and said explosive means and said second tubular member;

detonating means transversing said member for detonating said explosive means; and coupling means for coupling said first and second tubular members, spacers and explosive means.

16. The apparatus of claim 15 wherein said coupling means further comprises a sleeve overlapping said spacers, explosive means and adjacent portions of said first and second members, for coupling said first and second members, spacers and explosive means, and said sleeve including a groove in the exterior of said sleeve concentric to said explosive means for providing a fracture point in said sleeve.

17. The apparatus of claim 16 wherein said closed vent ports further comprise:

means for precluding fluid flow between said well bore and said tubing annulus set into apertures in said sub.

18. The apparatus of claim 17 wherein said means for precluding fluid flow between said well bore and said tubing annulus further comprises a rupture disc.

19. The apparatus of claim 11 wherein said detonating means comprises means for detonating said explosive means and said perforating apparatus.

* * * * *